US012698619B2

(12) United States Patent
Kean

(10) Patent No.: US 12,698,619 B2
(45) Date of Patent: Aug. 4, 2026

(54) METHOD AND SYSTEM OF CONFIGURING A MACHINE CONTROL UNIT OF A CONSTRUCTION MACHINE

(71) Applicant: LEICA GEOSYSTEMS TECHNOLOGY A/S, Odense (DK)

(72) Inventor: Michael Goulet Kean, Odense (DK)

(73) Assignee: LEICA GEOSYSTEMS TECHNOLOGY A/S, Odense Sø (DK)

( * ) Notice: Subject to any disclaimer, the term of this patent is extended or adjusted under 35 U.S.C. 154(b) by 154 days.

(21) Appl. No.: 18/234,868

(22) Filed: Aug. 16, 2023

(65) Prior Publication Data

US 2024/0060275 A1 Feb. 22, 2024

(30) Foreign Application Priority Data

Aug. 17, 2022 (EP) ..... 22190684

(51) Int. Cl.
*E02F 9/26* (2006.01)
*E02F 3/84* (2006.01)

(52) U.S. Cl.
CPC ..... *E02F 9/262* (2013.01); *E02F 3/841* (2013.01)

(58) Field of Classification Search
CPC ..... E01C 19/0004; E02F 3/842; E02F 9/264; E02F 3/7609; E02F 3/264; G05D 1/0219; B60R 1/23; G06V 20/46; B29C 64/393
See application file for complete search history.

(56) References Cited

U.S. PATENT DOCUMENTS

| | | | | |
|---|---|---|---|---|
| 11,634,890 | B2 * | 4/2023 | Tanimoto | E02F 9/264 701/34.2 |
| 11,994,870 | B2 * | 5/2024 | Shinkai | G05D 1/0219 |
| 12,018,462 | B2 * | 6/2024 | Jagoda | E02F 9/264 |
| 2013/0006484 | A1 | 1/2013 | Avitzur et al. | |
| 2016/0076228 | A1 * | 3/2016 | Nau | E02F 3/842 701/50 |
| 2017/0200306 | A1 | 7/2017 | Marsolek | |
| 2019/0078292 | A1 | 3/2019 | Ono | |
| 2019/0275736 | A1 * | 9/2019 | Yamaguchi | B29C 64/393 |

(Continued)

FOREIGN PATENT DOCUMENTS

| | | | |
|---|---|---|---|
| CN | 110191989 | A | 8/2019 |
| CN | 110409530 | A | 11/2019 |

(Continued)

OTHER PUBLICATIONS

Extended European Search Report dated Feb. 13, 2023 as received in Application No. 22190684.5.

*Primary Examiner* — Yuri Kan
(74) *Attorney, Agent, or Firm* — Maschoff Brennan

(57) ABSTRACT

A system and method for configuring a machine control unit of a construction machine for performing an earth-moving operation, the earth-moving operation comprising a multitude of phases that are to be performed consecutively, the method comprising, by a computing unit: receiving three-dimensional measuring data of a terrain in a surrounding of the construction machine in at least a first detection range, detecting elements of a previous phase of the earth-moving operation based on the three-dimensional measuring data, and configuring, based at least on the detected elements, the machine control unit to at least partially perform the next phase of the earth-moving operation automatically.

20 Claims, 6 Drawing Sheets

(56) References Cited

U.S. PATENT DOCUMENTS

| | | | | |
|---|---|---|---|---|
| 2019/0370562 | A1* | 12/2019 | Yigit | G06V 20/46 |
| 2021/0246636 | A1 | 8/2021 | Mathew et al. | |
| 2023/0001854 | A1* | 1/2023 | Bruflodt | B60R 1/23 |

FOREIGN PATENT DOCUMENTS

| | | | |
|---|---|---|---|
| CN | 112257163 | A | 1/2021 |
| CN | 113950661 | A | 1/2022 |
| EP | 3 086 196 | A1 | 10/2016 |
| EP | 3 865 895 | A1 | 8/2021 |
| EP | 3 194 666 | B1 | 12/2021 |
| JP | 2019-167719 | A | 10/2019 |
| WO | 2019/197064 | A1 | 10/2019 |
| WO | 2020/126123 | A2 | 6/2020 |

* cited by examiner

METHOD AND SYSTEM OF CONFIGURING A MACHINE CONTROL UNIT OF A CONSTRUCTION MACHINE

BACKGROUND

The present disclosure generally relates to a method and system for configuring a machine control unit of a construction machine to control an earth-moving operation that comprises a multitude of phases that are to be performed consecutively, for instance for controlling a motor grader or crawler for ditch or road construction. The controlling comprises using 3D sensors to detect a current state of the earth-moving operation in order to configure the machine control unit to at least partially control the construction machine during the next phase of the earth-moving works.

It is known to use automation systems for construction machines to facilitate earth-moving operations for the operator of the machine by fully or partially controlling the machine. Existing automation systems focus primarily on a final grading pass required to cut the soil surface to the desired profile. There are two primary applications that differ based on whether the desired profile is localized relative to world coordinates ("3D system"), or the desired profile is localized relative to vehicle coordinates ("2D system"). 2D systems are simpler to work with. A soil profile is designed relative to the vehicle system and the operator is fully responsible for navigating the vehicle so that the system generates the correct surface. 3D systems require a surface design file that is created using a complex computer system. The machine can then be localized relative to the 3D plan and the surface cut correctly with a variety of possible navigation motion.

There are various measuring systems known for the specific needs in the field of construction, especially for earth-moving machines, such as excavators, graders or dozers. Such measuring systems can be used with a construction machine to build a digital 3D model of the surroundings of the machine, to detect obstacles in the surroundings of the machine, and/or to support a control of the construction machine. For example, EP 3 086 196 A1 suggests an environment detection by means of a camera system arranged on a bulldozer. The camera system uses a SLAM or SfM algorithm to generate a 3D point cloud of the environment. JP 2019 167 719 A2 discloses a 2D laser scanner by means of which a 3D model of the environment is generated when an excavator, on which the 2D scanner is mounted, is pivoting. WO 2019/197064 A1 shows a device for monitoring a construction machine environment with a ToF camera. Images generated in such a way are used for guiding an operator of the construction machine in order to control the operation of the construction machine on the construction site according to a plan.

Advances in perception sensors allow for a new interactive workflow that enables a 3D design surface to be generated in a simpler manner, resembling that of existing 2D systems. These same perception sensors allow for the machine to localize itself relative to coordinates of a design file and enable advancements in the automation of the machine so that the automation systems can be used in a wider range of operator conditions. WO 2020/126123 A2 discloses an example of a compact "reality capture device" comprising a laser scanner and at least one camera. With this reality capture device, an environment can be optically scanned and measured by means of the laser scanner emitting a laser measurement beam, e.g. using pulsed electromagnetic radiation, wherein an echo is received from a backscattering surface point of the environment and a distance to the surface point is derived and associated with an angular emission direction of the associated laser measurement beam. This way, a three-dimensional point cloud is generated. For example, the distance measurement may be based on the time of flight, the shape, and/or the phase of the pulse. For additional information, the laser scanner data is combined with camera data, in particular to provide high-resolution spectral information, e.g. by means of an RGB camera or an infrared camera. The reality capture device may be mobile and configured to provide surveying data and referencing data at the same time, e.g. wherein at least trajectory data of the device, e.g. position and/or pose data, are provided with the probing data, e.g. laser scanner data and/or camera data, such that probing data of different positions of the reality capture device can be combined into a common coordinate system. The reality capture devices can be configured to autonomously create a 3D map of a new environment, e.g. by means of a simultaneous localization and mapping (SLAM) functionality. The European patent application No. 21176387.5 discloses a similar reality capture device comprising an arrangement of time-of-flight (ToF) cameras instead of a laser scanner, wherein the ToF cameras are configured for jointly capturing 3D point cloud data of the surrounding.

EP 3 865 895 A1 discloses a measurement system for construction machines comprising one or more reality capture devices for capturing surroundings of the construction machine before and during earthmoving works at a construction site.

Some earth-moving operations comprise a multitude of phases that are to be performed consecutively, wherein the phases are at least partly iterative. One example of such an operation is "V-ditching", which is used for construction a ditch with a V-shaped profile. During consecutive passes of the construction machine, the tool is continuously lowered to perform several cuts.

SUMMARY

It would be desirable to provide a construction site measuring system for a construction machine that facilitates performing such earth-moving operations for the operator of the construction machine, particularly by allowing a higher grade of automation in the control of the machine.

It is therefore an object of the present disclosure to provide an improved system and method for configuring a machine control unit of a construction machine for performing an earth-moving operation.

It is a further object of the disclosure to provide such a system and method that allow configuring the machine control unit to perform the earth-moving operation at least partially automatically.

It is a further object of the disclosure to provide such a system and method that allow configuring the machine control unit to perform at least a subset of phases of an earth-moving operation that comprising a multitude of phases that are to be performed consecutively.

A first aspect pertains to a system for configuring a machine control unit of a construction machine for performing an earth-moving operation, the earth-moving operation comprising a multitude of phases that are to be performed consecutively. Said system comprises a measuring system configured for capturing three-dimensional measuring data of a terrain in a surrounding of the construction machine in at least a first detection range, a user interface configured for receiving user input from an operator of the construction machine, and a computing unit operatively coupled at least with the measuring system, the user interface and the machine control unit. According to this aspect, the computing unit is configured for detecting elements of a previous phase of the earth-moving operation based on the three-dimensional measuring data, and, based at least on the detected elements, for configuring the machine control unit to perform the next phase of the earth-moving operation at least partially automatically.

According to some embodiments of the system, the measuring system comprises at least one measuring unit at the construction machine, each measuring unit being configured for capturing 3D point cloud data, i.e. as the three-dimensional measuring data. Each measuring unit comprises:

at least one laser scanner, a plurality of ToF cameras, a millimetre wave radar system, and/or one or more stereo camera systems.

According to some embodiments, the system comprises a context camera having a known position relative to the measuring system and/or the three-dimensional measuring data and being configured for capturing context image data of the terrain within the first detection range. In this case, the user interface is configured for displaying at least one context image based on the context image data to an operator of the construction machine, the computing unit is configured for overlaying the detected elements on the displayed context image and for receiving input from the operator related to a next phase of the earth-moving operation, and configuring the machine control unit is also based on the input from the operator. Optionally, the user interface may comprise a touch-sensitive display on which the context image is displayed and on which the user input is received. The input from the operator for instance may comprise a selection of one or more of the detected elements.

According to some embodiments, the construction machine is a motor grader and the earth-moving operation comprises construction a ditch, wherein the phases are passes of the motor grader along a ditch line, including a plurality of cutting passes, and the detected elements comprise an edge and/or surface produced by a previous cutting pass. For instance, the earth-moving operation may comprise V-ditching. Optionally, the input from the operator may comprise one or more of the following:

selecting an edge and/or surface produced by a previous cutting pass;

selecting a cutting depth for the next pass; and/or selecting to maintain a parallel cut for the next pass.

In one embodiment, the input from the operator comprises selecting an edge and a surface produced by a previous cutting pass and selecting to adjust a cross slope of the surface for the next pass while maintaining the selected edge as a vertex of a plane to be shaped during the next pass.

According to some embodiments of the system, the computing unit is configured for receiving operator input indicating a desired line (for instance a spline), along which line the earth moving operation is desired to be performed, localizing the construction machine based on the three-dimensional measuring data, e.g. relative to the desired line, positioning the tool at the desired line, and performing a first phase of the multitude of phases, thereby producing detectable elements.

Optionally, the computing unit also may be configured for steering the construction machine to the desired line.

In some embodiments, the operator input comprises an offset of the desired line from a given line and the computing unit is configured to calculate the desired line based on the offset. For instance, if the given line is a spline, the computing unit may be configured to calculate another spline as the desired line based on the offset. In one example, the given line may be a line belonging to an existing ditch on a first side of the road, and the desired line is for another ditch to be constructed on the other side of the road, e.g. with the same distance to the road as the ditch on the first side.

According to some embodiments of the system, the measuring system is configured for continuously capturing the 3D measuring data and for continuously providing the captured 3D measuring data to the computing unit, wherein the computing unit is configured for continuously evaluating the received 3D measuring data for continuously detecting the elements and for continuously configuring the machine control unit while at least partially automatically performing a phase of the earth-moving operation.

A second aspect pertains to a construction machine, e.g. a grader, a dozer or an excavator, the construction machine comprising a tool for performing an earth-moving operation, e.g. for digging a ditch or trench, a control unit for at least partially controlling the earth-moving operation, and a system according to the first aspect, the system being operatively coupled with the control unit or comprising the control unit.

A third aspect pertains to a computer-implemented method for configuring a machine control unit of a construction machine (e.g. the construction machine according to the second aspect), for performing an earth-moving operation, the earth-moving operation comprising a multitude of phases that are to be performed consecutively. The method comprises the following steps that are performed by a computing unit (e.g. the computing unit of the system according to the first aspect):

receiving 3D measuring data of a terrain in a surrounding of the construction machine in at least a first detection range;

detecting elements of a previous phase of the earth-moving operation based on the 3D measuring data; and configuring, based at least on the detected elements, the machine control unit to at least partially perform the next phase of the earth-moving operation automatically.

According to some embodiments, the method further comprises:

capturing context image data of the terrain within the first detection range using a context camera having a known position relative to the 3D measuring data and/or to a measuring system capturing the 3D measuring data;

displaying at least one context image based on the context image data to an operator of the construction machine, overlaying the detected elements on the displayed context image; and receiving input from the operator related to a next phase of the earth-moving operation, particularly wherein the input from the operator comprises a selection of one or more of the detected elements, wherein configuring the machine control unit is also based on the input from the operator.

According to some embodiments of the method, the construction machine is a motor grader and the earth-moving operation comprises constructing a ditch, for instance by V-ditching. In this case, the phases are passes of the motor grader along a ditch line, including a plurality of cutting passes, and the detected elements comprise an edge and/or surface produced by a previous cutting pass. Optionally, the input from the operator may then comprise one or more of the following:

- selecting an edge and/or surface produced by a previous cutting pass,
- selecting to maintain a parallel cut for the next pass, and/or
- selecting a cutting depth for the next pass.

In one embodiment, the input from the operator comprises selecting an edge and a surface produced by a previous cutting pass and selecting to adjust a cross slope of the surface for the next pass while maintaining the selected edge as a vertex of a plane to be shaped during the next pass.

According to some embodiments, the method further comprises:

- receiving operator input indicating a desired line, e.g. a spline, along which line the earth moving operation is desired to be performed,
- localizing the construction machine based on the three-dimensional measuring data, particularly relative to the desired line,
- positioning the tool at the desired line, and
- performing a first phase of the multitude of phases, thereby producing detectable elements.

Optionally, the method may further comprise automatically steering the construction machine to the desired line. In one embodiment, the operator input comprises an offset of the desired line from a given line and the method comprises calculating the desired line based on the offset.

According to some embodiments of the method, the 3D measuring data is captured continuously and evaluated continuously for detecting the elements, and the machine control unit is configured continuously while at least partially automatically performing a phase of the earth-moving operation.

According to some embodiments of the method, the earth-moving operation comprises constructing a ditch, the desired line is a ditch line, e.g. a ditch edge line, the first phase is a marking pass along the ditch line, and the produced elements produced by the marking pass comprise an edge and/or surface. Optionally, the construction machine may be a motor grader, the earth-moving operation may comprise V-ditching, and/or the ditch line may be a ditch edge line, a ditch spline or a ditch edge spline.

A fourth aspect pertains to a computer programme product comprising programme code which is stored on a machine-readable medium, or being embodied by an electromagnetic wave comprising a programme code segment, and having computer-executable instructions for performing, particularly when executed on a computing unit of a system according to the first aspect, the method according to the third.

BRIEF DESCRIPTION OF THE DRAWINGS

By way of example only, preferred embodiments will be described more fully hereinafter with reference to the accompanying figures, wherein.

DETAILED DESCRIPTION

Figure 1A:
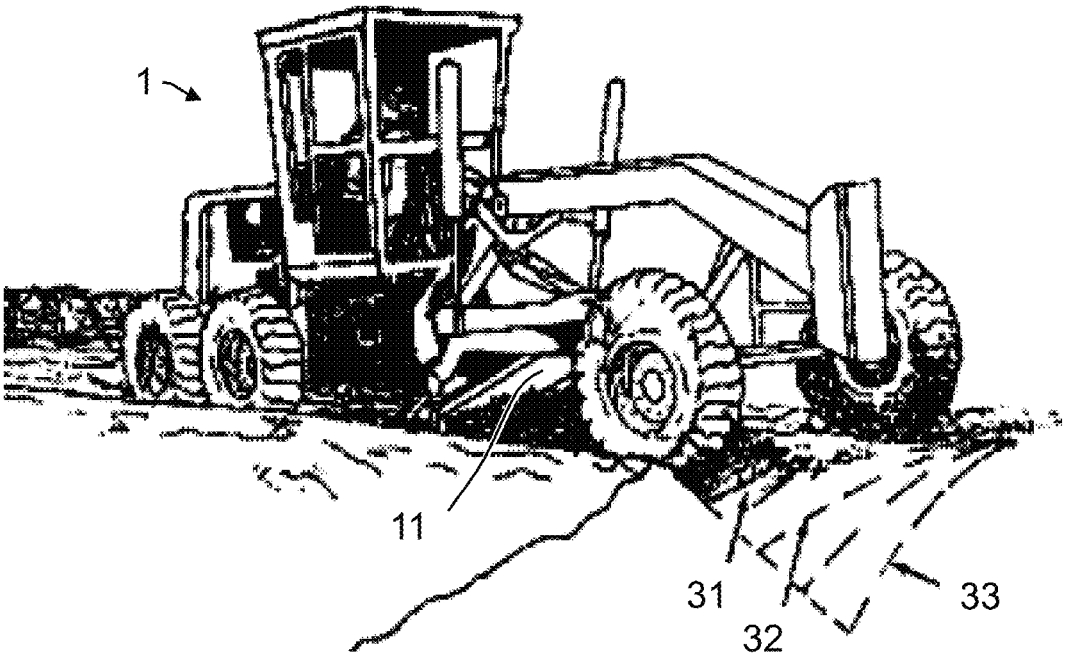
FIGS. 1*a-b* show two exemplary embodiments of known construction machines for performing earth-moving operations.
Figure 1B:
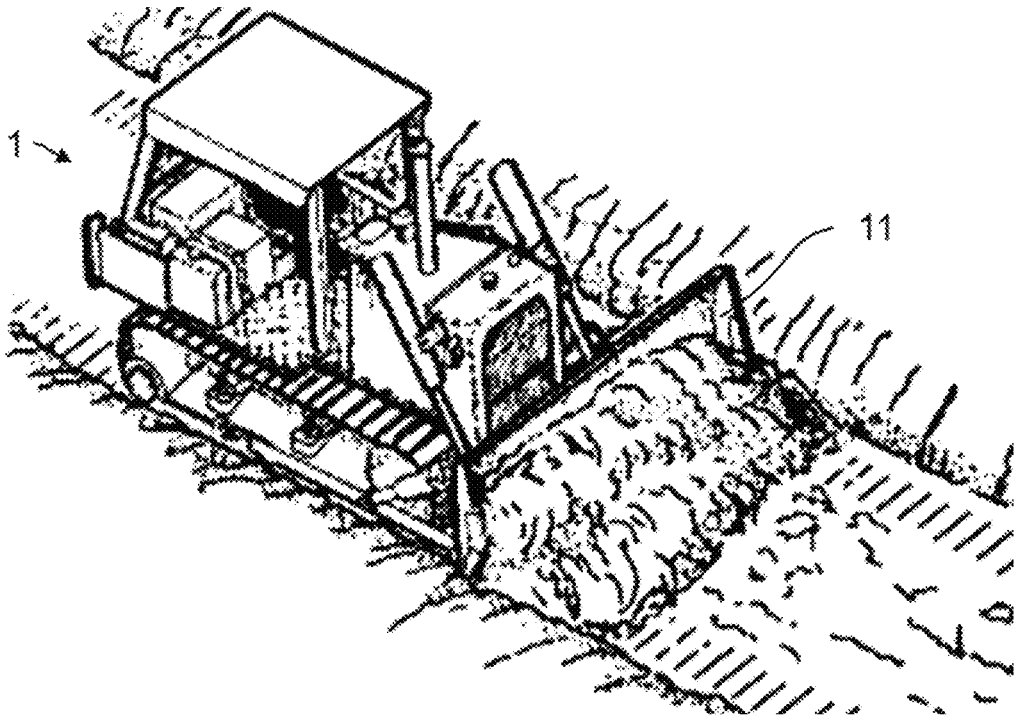

FIGS. 1*a* and 1*b* show two examples of known construction machines 1 that may be equipped with a system. FIG. 1*a* shows a motor grader using its tool 11 for digging a V-shaped ditch. This is an iterative process wherein the tool is continuously lowered to perform several cuts. These cuts include an initial light cut as a marking cut 31 and a number of subsequent heavier cuts comprising at least a first cut 32, and a final cut 33. FIG. 1*b* shows a crawler (also called bulldozer or dozer) having a blade as a tool 11 for performing earth-moving works, e.g. during road construction. It is known to equip such construction machines 1 with automation systems to facilitate earth-moving operations for the operator by at least partially controlling the machine during these operations.

In the construction machines 1 shown here, i.e. in graders and crawlers, current automation systems often comprise grade control systems that can be configured to maintain a desired cross slope. This is a simple functionality that can be used by operators during road construction and ditch construction. Typical cross slope systems only control one axis of a tool motion. They act as kinematic constraints, requiring the operator to control a depth of the tool 11, navigate the machine 1, and control other tool motions, e.g. associated with material management.

Figure 2:
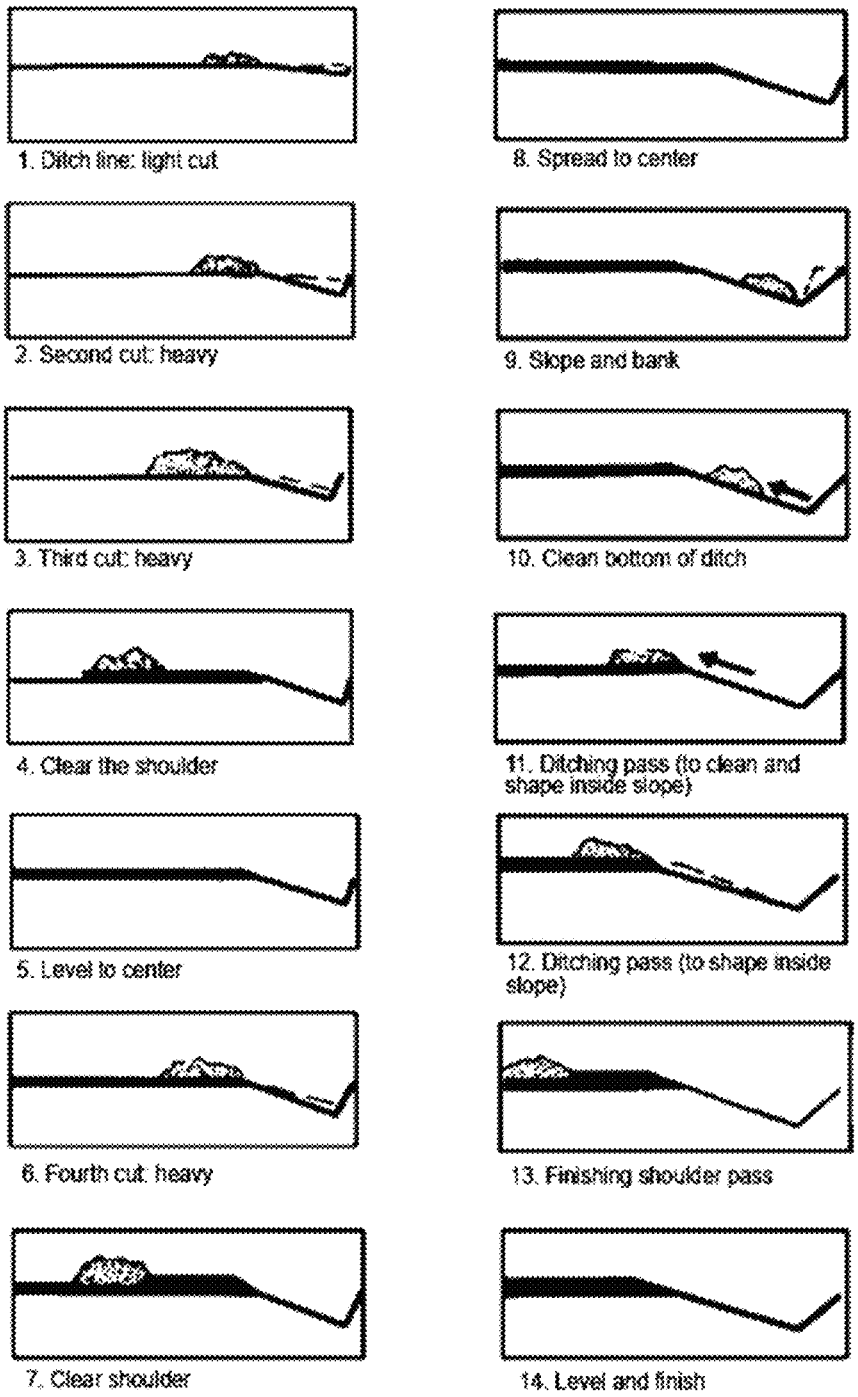
FIG. 2 illustrates an exemplary method for constructing a ditch using a motor grader.

FIG. 2 illustrates an exemplary method for digging a V-shaped ditch ("V-ditching") using a motor grader as shown in FIG. 1*a*. Such a method is known per se. Currently, performing this method takes a lot of attention from the operator of the grader since controlling the grader is performed mainly manually. Known cross-slope systems may control a single actuator out of the five that are used for blade motion. Disadvantageously, this requires the operator to manage several aspects of blade control while additionally having to navigate the vehicle.

The operator of a motor grader starts with a light marking cut (see also FIG. 1*a*) for marking a ditch line. The operator may then engage a known 2D cross-slope system, set the system for the desired ditch slope, and then proceed to subsequently make several cutting passes. During these passes the operator manages the load on the vehicle by adjusting the depth of cut and the angle of the blade. The angle of the blade also serves to shift material laterally along the blade and into a windrow. After several cutting passes, a significant windrow has been generated. The operator then disengages the cross-slope system and works to first shift the windrow and then spreads it thinly. Additional passes and windrow spreading operations are undertaken until one surface of the ditch is completed. The operator can once again engage the 2D cross-slope system while cutting the bank. During these passes, the soil is pushed onto the previously shaped surface. Once the embankment has been shaped, the operator once again clears the material from the ditch using the 2D cross-slope system. The cross-slope system is adjusted for a final surface cut. The windrow is then spread and shaped to the desired height and slope.

Figure 3A:
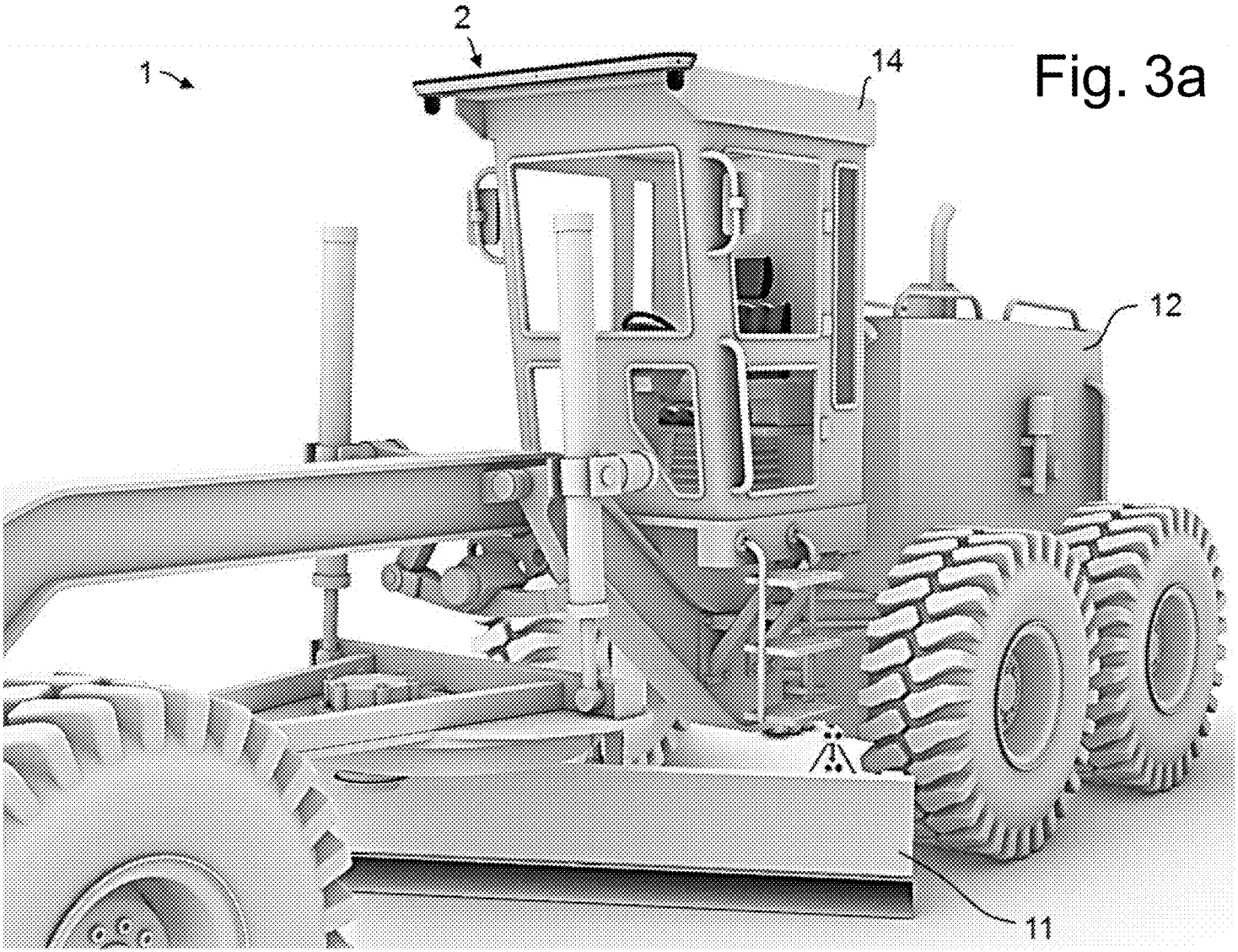
FIGS. 3*a-b* show a motor grader as an example of a construction machine, the grader comprising an exemplary embodiment of a construction site measuring system.
Figure 3B:
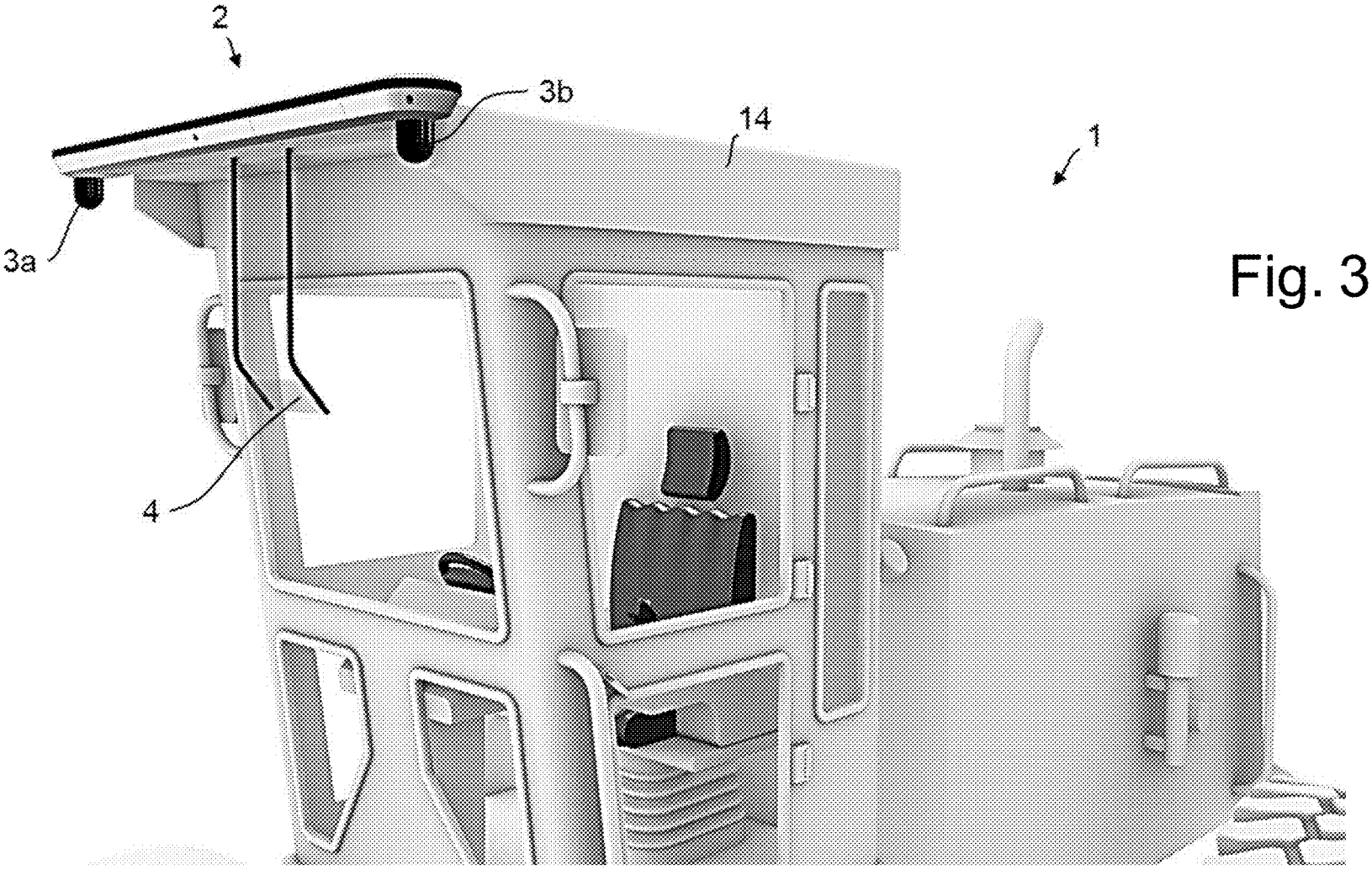

FIGS. 3*a* and 3*b* show a motor grader as an example of a construction machine 1, the grader comprising an exemplary embodiment of system for configuring a machine control unit of the construction machine. This system comprises a construction site measuring system with perception sensors which may be included in performing earth-moving operations thus enabling a drastic expansion of the automation used. The disclosed method and system provide an extension to existing 2D systems on construction machines, such as crawlers and motor graders. This is based on the addition of perception sensors that add environmental context that existing 2D systems lack.

As shown in FIG. 3*a*, the construction machine 1 comprises a tool (blade 11) for performing earthmoving works. Although the shown machine is a motor grader, it could as well be any other construction machine usable in earthmoving works, such as an excavator or a dozer. A measuring unit 2 is mounted on a cab 14 of the grader 1 as part of the construction site measuring system.

As shown in more detail in FIG. 3*b*, the measuring unit 2 comprises one or more reality-capture devices (RCD) 3*a*, 3*b* to capture three-dimensional (3D) measuring data of a surrounding (usually uneven) terrain. The 3D measuring data—for instance being or comprising a 3D point cloud—is captured in at least one capturing direction. Preferably, this includes a direction towards the front of the construction machine and usually at least partially matches the viewing direction of the operator while operating the machine.

In context, an RCD in particular comprises some sensor arrangement to capture a 3D point cloud of the environment using a non-contact method. Typically, this includes determining distances to points in the environment using time-of-flight (ToF) measurements based on light waves (e.g. in the infrared spectrum), radio waves, or ultrasonic sound waves. However, stereoscopic vision sensors can provide point-cloud measurements of the environment using disparity, or the difference in position of data in the left and right images. For instance, each RCD may comprise at least two cameras and optionally other sensors, such as a laser scanner or an arrangement of ToF cameras. Reality-capture devices 3*a,b* of one or more measuring units 2 may be configured to contribute to generating the same 3D point cloud of the terrain, to detect obstacles and/or to track persons or animals entering a danger zone around the machine. Measuring units 2 may be provided on many parts of the construction machine, for instance connected to the tool 11, on the chassis 12 and/or on the cab 14.

The system for configuring the machine control unit comprises a computing unit and a user interface. Preferably, the user interface may be provided at or inside the cab 14 so that it may be used by an operator of the excavator 1 during operation. The user interface comprises a display for displaying live images and/or a graphical user interface (GUI). In the exemplary embodiment shown in FIG. 3*b*, the user interface comprises a semi-transparent display 4 that is provided in front of the cab 14, allowing the operator to view the displayed content without having to avert his eyes from the terrain ahead.

The user interface comprises input devices that preferably are provided inside the cab 14—e.g. comprising a touch-sensitive display (touchscreen) and optionally a stylus for use with the touchscreen. The computing unit can use the measuring data generated by the measuring unit (RCD data)—e.g. LiDAR data from a LiDAR scanner and image data from a multitude of cameras—for generating a 3D model, e.g. of the construction site or parts thereof, and optionally also for obstacle detection.

The construction site measuring system additionally may comprise at least one of the following components, which optionally may be provided in a common housing together with the measuring unit 2 or in a common housing together with the computing unit and/or the user interface:

- a GNSS-antenna configured for generating position data,
- an Inertial Measurement Unit (IMU) configured for generating IMU data, and
- a cellular unit configured for transmitting any data to a remote station or other vehicles, e.g. construction machines or haul trucks on the same construction site.

For instance, if the measuring data comprises LiDAR data and image data, the image data can be used for colouring the LiDAR data and/or for optimizing a referencing of the LiDAR data by matching them with an image-based generated point cloud (e.g. generated by a visual simultaneous localization and mapping (VSLAM) algorithm). Also a feature tracking and/or feature recognition algorithm can help combining the LiDAR data to a consistent and well-referenced global point cloud. Similarly, the position data gained with the GNSS-antenna and the IMU data from the IMU can be used for a sensor fusion to obtain a higher precision when building a 3D model of the terrain. A VSLAM point cloud generation can also be supported on LiDAR data, in particular in such a way that the LiDAR data introduce scale and thereby increase stability of the algorithm. The LiDAR scanners may be configured for generating the LiDAR data while the two rotation axes of each scanner rotate faster than 0.1 Hz, particularly faster than 1 Hz, with a point acquisition rate of at least 300,000 points per second, particularly at least 500,000 points per second.

LiDAR scanners—as well as ToF cameras—may be capable to capture a 3D representation of the surrounding at a very fast pace. Therefore, with a moving construction machine it is possible to generate a coherent 3D point cloud based on a SLAM (Simultaneous Localization and Mapping) algorithm that uses the LiDAR data or the ToF data—either alone or in combination with image data from the cameras. Such localization and mapping is specifically advantageous if the construction machine is operating under a bridge or some other place shadowed from GNSS signals. The SLAM algorithm may be supported by at least one IMU providing IMU data that may be processed to stabilize the algorithm. In particular, all such fused sensor data can be processed by a Kalman filter.

Optionally, the system for configuring the machine control unit may also comprise at least one context camera, e.g. as a part of the construction site measuring system. Said context camera is any camera device that generates an image that provides context of the environment. In particular, the context camera need not provide any data for use in a sensor system. However, images provided by a stereoscopic camera are suitable for use as a context camera in addition to their use as a sensor through the calculation of a disparity map. The context camera may be provided in a common housing together with the RCD 3*a,b* of the measuring unit 2, at the semi-transparent display 4 or in a common housing together with the computing unit and the user interface. The context image data may be related to the RCD data of the construction site measuring system through the use of extrinsic parameters, which characterize the relative position of the context camera and RCDs as they are mounted on the construction machine 1. Images taken by the context camera are displayable to the operator of the machine on the semi-transparent display 4, on a touchscreen and/or on any other display of the user interface, particularly as a live video.

The use of one or more RCDs 3*a,b* mounted to the construction machine enables the entire work plan to be localized to the site based on the RCD data. If the RCDs are used for navigation or mapping (e.g. some variant of SLAM), then a design file can be localized to that navigation frame. If the machine is outfitted with GNSS or another global localization system, then the RCD data can be localized to global coordinates and the design file can be localized to the world frame as well. The design file can then be saved and output for reference or later use.

Figure 4:
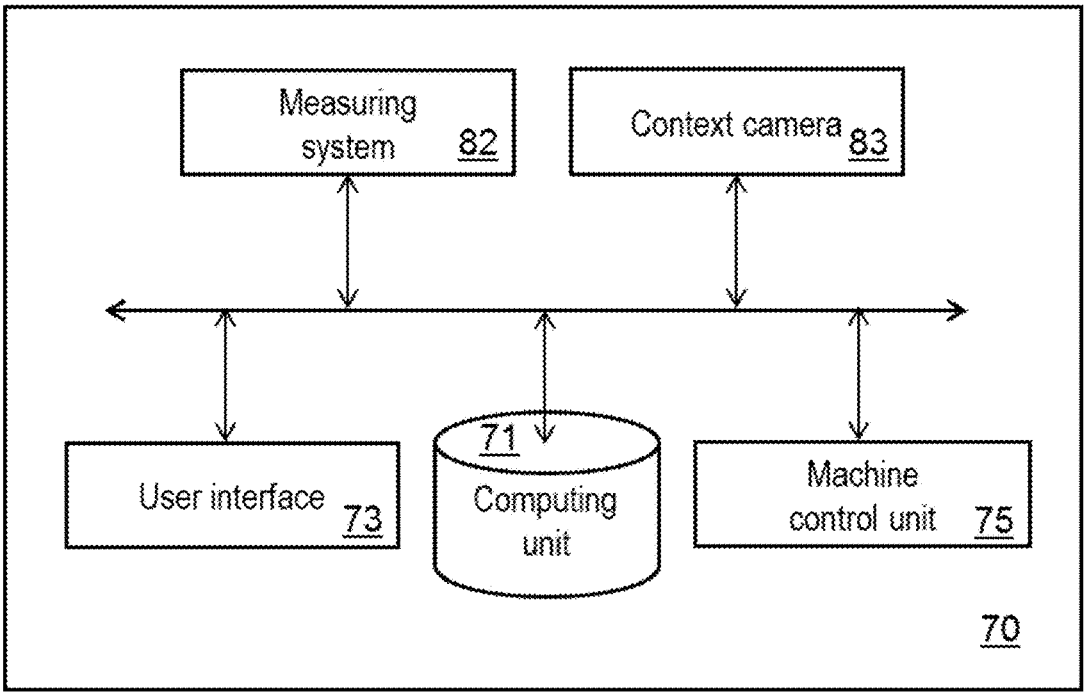
FIG. 4 shows an exemplary embodiment of a system.

FIG. 4 illustrates an exemplary embodiment of a system 70. It may be provided at least partially on a construction machine, e.g. on the motor grader of FIGS. 3*a* and 3*b*. The system 70 comprises a computing unit 71 that is operatively coupled with a user interface 73. The user interface is configured to present information to an operator of the system and to receive input from the operator. For instance, the user interface 73 may be provided in the cab of the excavator of the motor grader of FIGS. 3*a* and 3*b* and comprise a semi-transparent screen and/or a touchscreen.

The system may further comprise a machine control unit 75 operatively coupled with the computing unit 71. The machine control unit 75 is configured to aid the operator in performing earth-moving operations. In particular, this includes at least partially automatically supervising coordinates of a tool of the construction machine, for instance so that the blade of the motor grader of FIGS. 3*a* and 3*b* is prevented from digging below a pre-defined plane. Alternatively, the machine control unit 75 may be provided separately on the construction machine and be connectable to the system 70 so that it is operatively coupled with the computing unit 71.

The system 70 may also comprise one or more reality capture devices (RCD) 82 and at least one context camera 83 that are operatively coupled with the computing unit 71. An image of the context camera 83 is displayable on a screen, e.g. a touchscreen, of the user interface 73. Alternatively, the RCD 82 and context camera 83 may be provided separately on the construction machine and be connectable to the system 70 so that they are operatively coupled with the computing unit 71.

The computing unit 71 is configured to receive, from the RCD 82, point cloud data of a surface of a construction site, particularly of a surface of the surrounding of the construction machine. The computing unit 71 is configured to receive, from the user interface 73, user input regarding a planned earth-moving operation on the construction site. The computing unit 71 determines 3D coordinates of the planned earth-moving operation and programmes the machine control unit 75 accordingly.

Figure 5A:
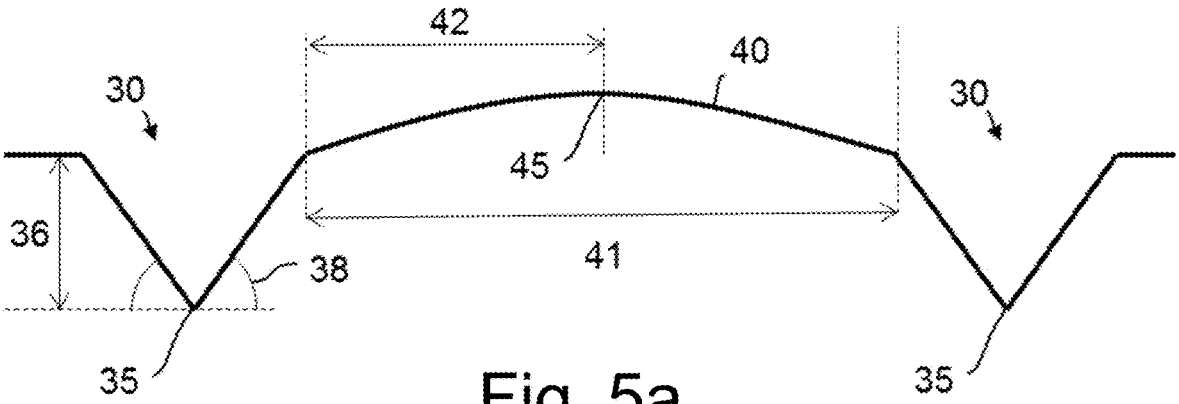
FIGS. 5*a-b* show a road design comprising ditches.

FIG. 5*a* shows a final road design in a cross section comprising ditches 30 on both sides of the road crown 40. The road and/or the ditches may be constructed using an embodiment of the system. For instance, the road design comprises values for a width 41 and/or half width 42 of a road crown 40. Regarding the ditches 30, values for a ditch depth 36, ditch wall angles 38 and a ditch offset 37 are provided, the ditch offset e.g. describing a distance between the ditch bottom edge 35 and either a road centre 45 or a road edge.

Figure 5B:
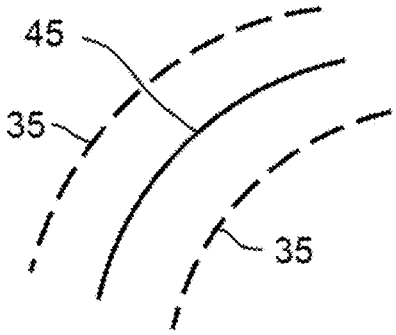

In order to construct a road with this cross section using the described system, it is necessary for the system to provide for spline offsetting. This allows the operator to use the inner edge of the ditch 30 to define the working direction of the road and then offset the shoulder edge and crown 40 of the road laterally in order to ensure they are parallel to the ditch line. The system should also be capable of generating and following curved splines for steering. This is illustrated in FIG. 5*b*, where calculated splines of the ditch edges 35 follow the given spline of the road centre 45. Alternatively, a spline of a first ditch edge 35 and of the road may be given, and a spline for a second ditch edge 35 that is to be constructed on the other side of the road is calculated. For instance, the spline is calculated with an offset so that both ditch edges 35 have the same distance to the road (e.g. to the respective side or to the centre 45 of the road).

A similar methodology can be used when slot grading with a crawler (as shown in Figure lb). The operator performs an initial marking cut and then configures the system to maintain the desired slope and navigate along the desired trench. The operator is then only responsible for managing vehicle load and shifting it from forward to reverse and vice versa until a windrow spreading operation is necessary. In a slot grading approach the operator sets a marking line and then uses the system to generate a windrow to either side of the crawler in order to develop a trench. The system then steers between the two windrows.

Figure 6:
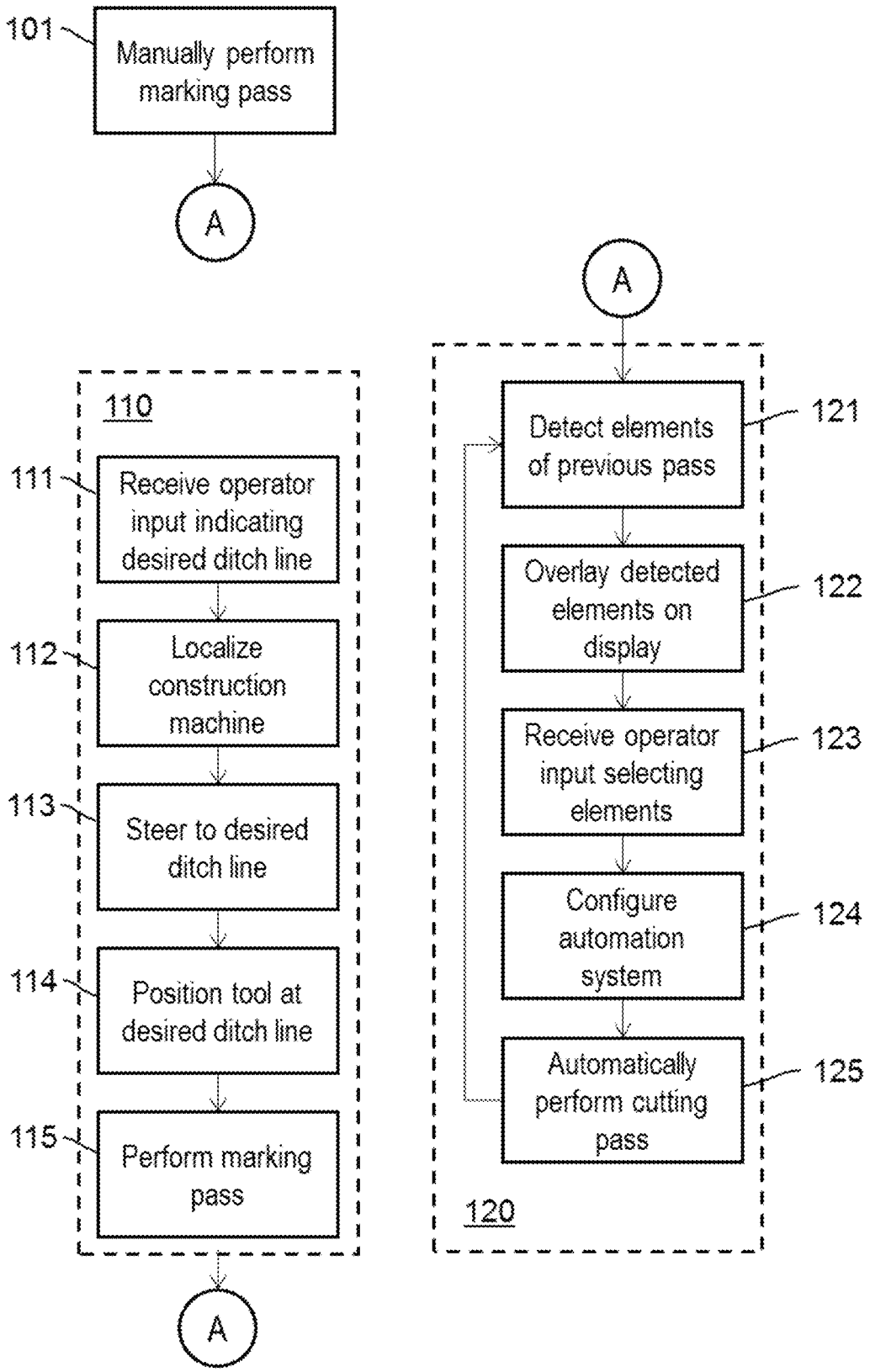
FIG. 6 shows a flow chart illustrating steps of exemplary embodiments of a method.

FIG. 6 is a flow-chart illustrating an exemplary embodiment of a method 100, i.e. a method for configuring a machine control unit of a construction machine for performing an earth-moving operation which comprises a multitude of phases that are to be performed consecutively. In the example described here, the earth-moving operation is a V-ditching operation (e.g. as described with respect to FIG. 2), and the phases are passes of a motor grader or similar machine along a ditch line, the passes including several cutting passes. The operator is assisted by an exemplary embodiment of a system in performing one or more of these passes.

Aside from V-ditching, other embodiments of the method and system are can also be used for other applications that comprise iterative passes over the same route to construct a structure, such as road building or slot grading. Aside from motor graders, the disclosed method and workflow can be used with other construction machines, such as crawlers and wheel loaders.

During performing the method, a three-dimensional point cloud of a 3D surface is captured, for instance using one or more reality-capture devices (RCD) mounted on a construction machine to capture the surface surrounding the machine. This allows localizing the construction machine as well as recognizing features in the surrounding. In particular, the 3D point cloud may be captured continuously. Optionally, a context camera having a known position relative to the 3D point cloud and/or to a measuring system capturing the 3D point cloud captures context image data of the surrounding of the machine.

The illustrated method starts with performing a marking or registration pass, where the soil is cut just enough to provide a registration line to aid steering on subsequent passes. The operator can either perform 101 the marking pass manually, or start an assistance procedure 110 to be assisted by the machine control unit of the construction machine and/or a system.

In the latter case, i.e. during the assistance procedure 110, the operator indicates a desired line for the marking pass ("ditch line"), for instance a straight line or a spline. This indication may comprise an input of coordinates or a line drawn in a context image displayed on a touchscreen. Also, the operator may select a feature in the context image, e.g. a road or similar structure, and indicate an offset for the desired line from the feature. Alternatively or additionally, a data file comprising the coordinates can be uploaded to the system.

This indication of the desired ditch line is received 111 as input by the system. Since the RCDs mounted to the construction machine enable localization 112 of the construction machine, optionally the automation system can be set to steer 113 to the desired ditch line and/or set to position 114 the tool, e.g. a toe of a mould board, at the designated ditch line and maintain this position, e.g. at least a height and inclination, while the construction machine follows the ditch line—either steered by the operator, or controlled by the automation system. The marking pass is thus performed 115 fully or partly automatically. In the latter case, for instance, the automation system actuates blade side shift in order to keep the tool, e.g. the toe of the mould board, at the desired position while the operator controls the steering, circle shift and circle angles.

After the marking pass has been made (manually 101 or using the assistance procedure 110), a following pass can begin, e.g. as shown here a cutting procedure 120 that includes making a first deep cut. Using the RCDs mounted to the construction machine, the construction site measuring system can automatically detect 121 edges and surfaces of the previous pass, i.e. of the marking pass or a previous cutting pass. These edges and surfaces may be detected 121, e.g., in image data and/or point cloud data captured by the RCDs.

The system can then present these detected elements in a display, for instance by overlaying 122 them in a context image displayed on a touchscreen, and allow the operator to select previously shaped edges and/or surfaces in order to configure the automation systems for a present cutting pass. For instance, the operator can select the edge of the previous cut and configure the system to cut 25 mm below it for the next pass. The operator can select the previous surface and configure the system to maintain a parallel cut for the following pass. The cut might also be intended to change the cross slope of the surface but use the previously sloped edge as a vertex of the plane being shaped on the subsequent cutting pass. These selections are received 123 as operator input on the user interface, e.g. on a touchscreen showing a context image, to configure 124 the automation system for fully or partly automatically performing 125 the cutting pass. This cutting procedure 120 can be repeated until the last pass has been made and the construction of the ditch is completed.

Optionally, if a user interface displays a context image on a touchscreen that is also used for receiving the operator input (e.g. in steps 111 and 123), the input may include a selection of pixels of the context image or be interpreted as such a selection of pixels. Since the context camera capturing the context image data has a known position relative to the measuring system and/or the 3D measuring data, the selection of pixels (e.g. representing a desired ditch line) can be mapped to the 3D measuring data, e.g. to a surface of a 3D terrain model that is generated based on the 3D measuring data. Based on the mapping, it is then possible to determine 3D coordinates on the surface that can be provided to the machine control unit for at least partially controlling the earth-moving operation. This is described in detail in the European patent application No. 22180149.1.

The data captured by the RCDs can also be used to monitor the shed material as it forms a windrow. The volume of material in the windrow or the height of the windrow can be used to indicate to the operator when it is necessary to perform a spreading pass (see e.g. steps 7 and 8 in FIG. 2). Alternatively or additionally, the control unit may be triggered to perform a spreading behaviour during the next pass or to automatically perform a spreading pass.

Optionally, the method may include storing information regarding previously identified lines and surfaces in a memory and retrieving this information in a subsequent pass. For instance, the method may comprise passes for cleaning a bottom of a ditch (see e.g. steps 9 and 10 in FIG. 2). In this case it would help the operator if the system remembers the location of the bottom edge of the ditch even when it is covered in soil. This would allow the operator to cut the inside slope of the ditch and then use the inner edge of the ditch when cutting the outer slope of the ditch and then again when clearing the soil out of the bottom of the ditch. It would be difficult to correctly define the offset using the upper edge of the ditch, but since the system knows where the bottom edge is relative to the upper edge, the operator can order it to steer to the hidden ditch line while clearing soil from the ditch, which is especially helpful if the ditch line is a spline.

In some embodiments, the system may be configured to self-configure. In this mode, the operator may set the cross-slope and height for the marking pass, incrementing the height until the correct depth is reached for a marking pass. The localization capability of the RCDs enables a globally consistent height to be maintained as the vehicle navigates the site. The operator can then use an increment button to tell the system the desired depth of each cutting pass. The construction site measuring system can use its localization capabilities to determine when it was at the beginning position of the job. It can then combine the localization data with the configuration for the previous cutting pass in order to automatically detect and identify the edges and surfaces cut by the machine. It can then automatically set the desired steering spline or mould-board toe line based on the previous pass and operator indicated depth.

According to some embodiments, a method and system can also be used to monitor the construction of a V-ditch. Since the system knows the workflow, it can be used to track the steps used in the construction as well as the system configuration and work product for each pass. This data provides a real-time status for the construction job and can also be used to train new operators, using the system to designate the desired workflow for inexperienced operators.

Optionally, the system may include a mechanism for sensing a load of the construction machine. This may include sensing engine torque, watching engine speed changes, hydrostatic loop pressures and or displacements, transmission output torque, torque converter torque, etc. In this case, a depth control of the control unit may be set to a load dependent state where the system can automatically adjust a height of the tool based on the detected load.

Although aspects are illustrated above, partly with reference to some preferred embodiments, it must be understood that numerous modifications and combinations of different features of the embodiments can be made. All of these modifications lie within the scope of the appended claims.

The invention claimed is:

1. A system for digging a ditch or a trench using a construction machine, the construction machine comprising a machine control unit and a blade, the digging comprising a multitude of phases that are to be performed consecutively, each phase comprising a pass of the grading machine along a digging line, the multitude of phases including a plurality of cutting passes in which the blade is used for performing cuts, wherein the system comprises:

a measuring system comprising one or more measuring units, at least one measuring unit being provided at the construction machine and being configured for capturing three-dimensional measuring data of a terrain in a surrounding of the construction machine in a first detection range;

a context camera having a known position relative to the measuring system and/or the three-dimensional measuring data and being configured for capturing context image data of the terrain within the first detection range;

a user interface configured for displaying at least one context image based on the context image data to an operator of the construction machine and for receiving user input from the operator of the construction machine; and a computing unit operatively coupled at least with the measuring system, the user interface and the machine control unit, wherein the computing unit is configured for detecting terrain elements produced by a previous phase of the digging based on the three-dimensional measuring data, the detected terrain elements comprising at least one of an edge and a surface;

overlaying the detected terrain elements on the displayed context image;

receiving input from the operator on the user interface, the input being related to a next phase of the digging and comprising a selection of one or more of:

an edge produced by a previous cutting pass, a surface produced by a previous cutting pass, and an edge and a surface produced by a previous cutting pass and a selection to adjust a cross slope of the surface for the next pass while maintaining the selected edge as a vertex of a plane to be shaped during the next pass; and configuring, based at least on the detected terrain elements and on the input from the operator, the machine control unit to at least partially perform the next phase of the digging automatically.

2. The system according to claim 1, each measuring unit being configured for capturing 3D point cloud data, wherein each measuring unit comprises:

at least one laser scanner, a plurality of ToF cameras, a millimetre wave radar system, and/or one or more stereo camera systems.

3. The system according to claim 1, wherein the user interface comprises a touch-sensitive display on which the context image is displayed and on which the user input is received.

4. The system according to claim 1, wherein the construction machine is a motor grader, the earth-moving operation comprises construction of a ditch, and the digging line is a ditch line.

5. The system according to claim 1, wherein the computing unit is configured for receiving operator input indicating a desired line, along which line the digging is desired to be performed, localizing the construction machine based on the three-dimensional measuring data, positioning the blade at the desired line, and performing a first phase of the multitude of phases, thereby producing detectable elements, particularly wherein the grading machine is localized relative to the desired line;

the computing unit is configured for steering the construction machine to the desired line; and/or the desired line is a spline.

6. The system according to claim 5, wherein operator input comprises an offset of the desired line from a given line and the computing unit is configured to calculate the desired line based on the offset, particularly wherein the given line is a spline and the computing unit is configured to calculate a spline as the desired line based on the offset.

7. The system according to claim 1, wherein the measuring system is configured for continuously capturing the three-dimensional measuring data and for continuously providing the captured three-dimensional measuring data to the computing unit;

the computing unit is configured for continuously evaluating the three-dimensional measuring data for detecting the elements and for continuously configuring the machine control unit while at least partially automatically performing a phase of the digging.

8. The construction machine, comprising the blade for digging the ditch or trench;

the machine control unit for at least partially controlling the digging; and the system according to claim 1, the system being operatively coupled with the machine control unit or comprising the machine control unit.

9. The construction machine according to claim 8, wherein the construction machine is a grader or a dozer.

10. A computer-implemented method for digging a ditch or a trench using a construction machine, the construction machine comprising a machine control unit and a blade, the digging comprising a multitude of phases that are to be performed consecutively, each phase comprising a pass of the construction machine along a digging line, the multitude of phases including a plurality of cutting passes in which the blade is used for performing cuts, the method comprising a computing unit receiving, from a measuring system comprising a measuring unit that is provided at the construction machine, three-dimensional measuring data of a terrain in a surrounding of the construction machine in a first detection range;

the computing unit detecting terrain elements produced by a previous phase of the digging based on the three-dimensional measuring data, the detected terrain elements comprising at least one of an edge and a surface;

a context camera capturing context image data of the terrain within the first detection range, the context camera having a known position relative to the three-dimensional measuring data and/or to the measuring system;

displaying at least one context image based on the context image data to an operator of the construction machine, overlaying the detected terrain elements on the displayed context image;

receiving input from the operator on the user interface, the input being related to a next phase of the digging, the input from the operator comprising a selection of one or more of;

an edge produced by a previous cutting pass, a surface produced by a previous cutting pass, and an edge and a surface produced by a previous cutting pass and a selection to adjust a cross slope of the surface for the next pass while maintaining the selected edge as a vertex of a plane to be shaped during the next pass; and the computing unit configuring, based at least on the detected terrain elements and on the input from the operator, the machine control unit to at least partially perform the next phase of the digging automatically.

11. The method according to claim 10, wherein the construction machine is a motor grader, the digging comprises constructing a ditch, and the digging line is a ditch line.

12. The method according to claim 10, comprising receiving operator input indicating a desired line, along which line the digging is desired to be performed, localizing the construction machine based on the three-dimensional measuring data, particularly relative to the desired line, positioning the blade at the desired line, and performing a first phase of the multitude of phases, thereby producing detectable elements.

13. The method according to claim 12, wherein the method comprises automatically steering the construction machine to the desired line;

the desired line is a spline; and/or the operator input comprises an offset of the desired line from a given line and the method comprises calculating the desired line based on the offset.

14. The method according to claim 10, wherein the three-dimensional measuring data is captured continuously and evaluated continuously for detecting the terrain elements, and the machine control unit is configured continuously while at least partially automatically performing a phase of the digging.

15. The method according to claim 12, wherein the digging comprises constructing a ditch, the desired line is a ditch line, particularly a ditch edge line, the first phase is a marking pass along the ditch line, and the detectable elements produced by the marking pass comprise an edge and/or surface.

16. The method according to claim 15, wherein the construction machine is a motor grader;

the earth-moving operation comprises V ditching; and/or the ditch line is a ditch edge line, a ditch spline or a ditch edge spline.

17. A computer program product comprising program code which is stored on a non-transitory machine-readable medium, and having computer-executable instructions for performing the method according to claim 10.

18. The system according to claim 1, wherein the construction machine is a dozer, and the digging comprises digging a trench.

19. The method according to claim 10, wherein the construction machine is a dozer, and the digging comprises digging a trench.

20. A system for construction of a ditch using a motor grader, the motor grader comprising a machine control unit, the construction of the ditch comprising V ditching in a multitude of phases that are to be performed consecutively, each phase comprising a pass of the motor grader along a ditch line, the multitude of phases including a plurality of cutting passes, the system comprising a measuring system comprising one or more measuring units, at least one measuring unit being provided at the motor grader and being configured for capturing three-dimensional measuring data of a terrain in a surrounding of the motor grader in a first detection range;

a context camera having a known position relative to the measuring system and/or the three-dimensional measuring data and being configured for capturing context image data of the terrain within the first detection range;

a user interface configured for displaying at least one context image based on the context image data to an operator of the motor grader and for receiving user input from the operator of the motor grader; and a computing unit operatively coupled at least with the measuring system, the user interface and the machine control unit, wherein the computing unit is configured for detecting terrain elements produced by a previous phase of the V ditching based on the three-dimensional measuring data, the detected terrain elements comprising at least one of an edge and a surface;

overlaying the detected elements on the displayed context image;

receiving input from the operator on the user interface, the input being related to a next phase of the V ditching and comprising a selection of one or more of:

an edge produced by a previous cutting pass, a surface produced by a previous cutting pass, and an edge and a surface produced by a previous cutting pass and a selection to adjust a cross slope of the surface for the next pass while maintaining the selected edge as a vertex of a plane to be shaped during the next pass; and configuring, based at least on the detected terrain elements and on the input from the operator, the machine control unit to at least partially perform the next phase of the V ditching automatically.

* * * * *